US010640726B2

(12) United States Patent
Waldron

(10) Patent No.: US 10,640,726 B2
(45) **Date of Patent: *May 5, 2020**

(54) GUN OIL COMPOSITION

(71) Applicant: MONGOOSE LUBRICANTS, LLC, Bountiful, UT (US)

(72) Inventor: Leonard A. Waldron, Bountiful, UT (US)

(73) Assignee: Mongoose Lubricants, LLC, Bountiful, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/327,141

(22) PCT Filed: Aug. 16, 2017

(86) PCT No.: PCT/US2017/047144
§ 371 (c)(1),
(2) Date: Feb. 21, 2019

(87) PCT Pub. No.: WO2018/044570
PCT Pub. Date: Mar. 8, 2018

(65) Prior Publication Data

US 2019/0225910 A1 Jul. 25, 2019

Related U.S. Application Data

(63) Continuation of application No. 15/250,663, filed on Aug. 29, 2016, now Pat. No. 9,637,705.

(51) Int. Cl.
*C10M 169/04* (2006.01)
*F41A 29/04* (2006.01)
(Continued)

(52) U.S. Cl.
CPC ..... *C10M 169/04* (2013.01); *C10M 107/02* (2013.01); *C10M 111/04* (2013.01);
(Continued)

(58) Field of Classification Search
CPC ..... C10M 169/042; C10M 169/04; C10M 169/044; C10M 107/02; C10M 111/04;
(Continued)

(56) References Cited

U.S. PATENT DOCUMENTS 2,734,868 A 2/1956 Bright et al.
3,850,825 A 11/1974 Vienna
(Continued)

FOREIGN PATENT DOCUMENTS

EP 0656414 A2 6/1995
EP 0684298 11/1995
SG 176341 12/2011

OTHER PUBLICATIONS

International Search Report and Written Opinion issued in PCT/US2017/047144 dated Nov. 3, 2017.
(Continued)

*Primary Examiner* — Taiwo Oladapo
(74) *Attorney, Agent, or Firm* — Workman Nydegger

(57) ABSTRACT

A gun oil composition adapted specifically for the needs and requirements of modern firearms. The gun oil composition improves lubricity and gun performance under normal and extreme heat and pressure, minimizes and largely prevents the build-up of carbon and debris fouling on metal and non-metal components of the firearm, and substantially reduces cleaning time, while providing increased protection against environmental components such as dust, dirt and rust. The gun oil composition can include a base oil having at least a high viscosity index, an oil having at least a medium viscosity index with a detergent additive, a low viscosity penetrating oil, and a sulfurized ester.

27 Claims, 5 Drawing Sheets

(51) Int. Cl.

| | |
|---|---|
| ***C10M 107/02*** | (2006.01) |
| ***C10M 111/04*** | (2006.01) |
| ***C10M 135/06*** | (2006.01) |
| ***C11D 7/34*** | (2006.01) |
| ***C11D 7/50*** | (2006.01) |
| ***C11D 11/00*** | (2006.01) |

(52) U.S. Cl.

CPC ..... *C10M 135/06* (2013.01); *C11D 7/34* (2013.01); *C11D 7/5027* (2013.01); *C11D 11/0029* (2013.01); *F41A 29/04* (2013.01); *C10M 2203/10* (2013.01); *C10M 2205/0206* (2013.01); *C10M 2205/0285* (2013.01); *C10M 2207/021* (2013.01); *C10M 2207/04* (2013.01); *C10M 2211/02* (2013.01); *C10M 2213/062* (2013.01); *C10M 2219/022* (2013.01); *C10M 2219/024* (2013.01); *C10M 2219/066* (2013.01); *C10M 2219/082* (2013.01); *C10M 2219/086* (2013.01); *C10M 2223/04* (2013.01); *C10M 2223/047* (2013.01); *C10M 2223/049* (2013.01); *C10M 2223/06* (2013.01); *C10N 2220/022* (2013.01); *C10N 2220/032* (2013.01); *C10N 2230/04* (2013.01); *C10N 2230/06* (2013.01); *C10N 2230/40* (2013.01); *C10N 2230/43* (2013.01); *C10N 2240/06* (2013.01)

(58) Field of Classification Search

CPC ..... C10M 135/06; C10M 2205/0206; C10M 2219/082; C10M 2211/02; C10M 2219/024; C10M 2219/066; C10M 2223/047; C10M 2223/049; C10M 2223/06; C10M 2203/10; C10M 2205/0285; C10M 2207/021; C10M 2207/04; C10M 2213/062; C10M 2219/022; C10M 2219/086; C10M 2223/04; F41A 29/04; C11D 7/34; C11D 7/5027; C11D 11/0029; C10N 2230/04; C10N 2220/022; C10N 2220/032; C10N 2230/06; C10N 2230/40; C10N 2230/43; C10N 2240/06

See application file for complete search history.

(56) References Cited

U.S. PATENT DOCUMENTS

| | | | | |
|---|---|---|---|---|
| 5,763,374 | A * | 6/1998 | Sakai | C10M 145/14 508/469 |
| 7,432,231 | B2 | 10/2008 | Gibbons | |
| 9,222,050 | B1 | 12/2015 | Simonetti et al. | |
| 9,637,705 | B1 * | 5/2017 | Waldron | C10M 111/02 |
| 2006/0194701 | A1 | 8/2006 | Gibbons | |
| 2008/0194439 | A1 | 8/2008 | Kato et al. | |
| 2011/0136714 | A1 | 6/2011 | Haigh et al. | |
| 2015/0252284 | A1 | 9/2015 | Waldron | |

OTHER PUBLICATIONS http://www.machinerylubrication.com/Articles/Print/29113; NORIA Corporation; Understanding the Differences in Base Oil Groups; accessed Aug. 25, 2016; pp. 1-3.

https://en.wikipedia.org/wiki/Viscocit_index; Wikipedia; Viscocity index; accessed Aug. 25, 2016; pp. 1-2.

Office Action dated May 11, 2016 from U.S. Appl. No. 14/197,024, filed Mar. 4, 2014.

Office Action dated Dec. 1, 2015 from U.S. Appl. No. 14/197,024, filed Mar. 4, 2014.

Office Action dated Sep. 30, 2016 from U.S. Appl. No. 15/250,663, filed Aug. 29, 2016.

Office Action dated Feb. 2, 2017 from U.S. Appl. No. 15/250,663, filed Aug. 29, 2016.

Notice of Allowance dated Mar. 13, 2017 from U.S. Appl. No. 15/250,663, filed Aug. 29, 2016.

Issue Notification dated Apr. 12, 2017 from U.S. Appl. No. 15/250,663, filed Aug. 29, 2016.

Extended European Search Report for EP17847207.2 dated Mar. 25, 2020.

Gutt et al., "Biodiesel Kinematics Viscosity Analysis of Balanite aegyptiaca Seed Oil", ARPN Journal of Engineering and Applied Sciences, Apr. 4, 2012, pp. 432-435, XP05567824, retrieved from the internet: URL: http://www.arpnjournals.com/jeas/research papers/rp 2012/jeas 0412 672.pdf [retrieved on Mar. 30, 2020] *table 2*.

* cited by examiner

GUN OIL COMPOSITION

CROSS REFERENCE TO RELATED APPLICATIONS

This application is a U.S. Nationalization of PCT Application Number PCT/US2017/047144, filed on Aug. 16, 2017, which claims priority to U.S. patent application Ser. No. 15/250,663 filed on Aug. 29, 2016, the entireties of which are incorporated herein by reference.

BACKGROUND OF THE INVENTION

1. The Field of the Invention

The present invention relates to a gun oil composition for use in modern firearms.

2. Background and Relevant Art

For outdoor and shooting enthusiasts, proper care and maintenance of outdoor gear is a priority for ensuring proper function and longevity of use of equipment. In particular, attention to proper cleaning and maintenance of firearms has been a point of emphasis for outdoor and shooting enthusiasts. Most traditional firearms are utilized in outdoor settings where rain, snow, dirt, dust, mud, humidity and other factors can cause rust or otherwise interfere with proper operation of a firearm.

Traditionally, firearm users are encouraged to clean and oil their firearms after each use. Traditional gun oils are intended to clean, lubricate and protect the metal components of the firearms from rust. Traditional gun oils are configured primarily as a barrier to keep metal parts from being exposed to oxygen and environmental oxidizing agents such as moisture. By providing a barrier between the metal and environmental elements such as air, humidity, water, and/or dirt, traditional gun oil protects the barrel of the firearm and other metal components of the firearm from the elements. In short, traditional gun oils are primarily designed to provide protection from rust and corrosion. However, traditional gun oil can also provide other benefits to the firearm including providing at least some lubrication (lubricity) to moving parts. Nevertheless, traditional gun oils are largely designed with the objective of preventing rust and corrosion, while only providing lubrication as an incidental benefit, under some conditions.

New developments in modern firearms have given rise to new needs and requirements for maintenance, cleaning, and repair. While traditional gun oil is the preferred oil of consumers, it is primarily formulated to prevent rust and corrosion from moisture and the elements. In other words, gun oils have not adapted to the extreme operating conditions which are frequently experienced with modern firearms.

Modern firearms have more complex designs compared to their traditional counterparts. Advancements in "AR" and "AK" technologies involve gas operated moving parts. For example, the AR Rifle (ArmaLite, Inc.) utilizes a direct impingement gas operation or long/short stroke piston operation. Gas operated moving parts rely on cycling of combustion exhaust from the firing of ammunition for proper operation of the firearm. As a result, fouling from combustion of the gunpowder in the ammunition is cycled back through the firearm, instead of simply being discharged from the end of the barrel like in traditional firearms. As a result, much higher volumes of carbon exhaust cycle through the moving parts of such modern firearms than in traditional firearms that rely on manual manipulation to cycle the action of the firearm. This leads to significantly faster and greater carbon build-up in modern firearms than in traditional firearms.

Modern firearms are also designed for greater round counts. For example, a user may regularly fire hundreds or even thousands of rounds in a single training session or over the course of a few days, whereas traditional firearms were designed for much less frequent and less extensive use (e.g., 10, 20 or a few dozen rounds). As a result of the greater round counts and the additional moving parts, the amount of friction and heat can be appreciably and substantially higher in modern firearms than in traditional firearms. Greater friction and heat combined with the build-up of carbon leads to fouling and the "baking on" of carbon directly on components of the firearm. It is not unusual for shooters to spend significant time and energy removing built-up carbon which has caked and baked onto pistons, control arms, or other internal components of a modern firearm.

A variety of tools and techniques have been developed to remove "baked-on" carbon from gun parts. Many of these tools are designed for manually scraping and loosening of the carbon or other build-up. Some strong solvents are also utilized to deal with cleaning and removing of carbon build up or other fouling. However, many such solvents are far from pH neutral and can actually damage the metal parts and external finish of the gun. Similarly, scraping can lead to scratching the surface of the metal. In many cases, after firing several hundred or several thousand rounds, the process of removing carbon build-up and cleaning the metal parts of the firearm is not only time-consuming, but can damage the firearm and detract from the precision, integrity, functionality, and value of the firearm, as well as the enjoyment of outdoor and shooting activities for those who clean and maintain the firearm.

Accordingly, there are a number of disadvantages to known gun oil compositions and the use thereof alone and in combination with other firearm care products, tools, and techniques that can be addressed.

BRIEF SUMMARY OF THE INVENTION

Implementations of the present invention address one or more of the foregoing or other problems in the art by providing a gun oil composition adapted to address the needs, requirements, and extreme operating environment and conditions of modern firearms. In particular, the gun oil composition is configured to provide greater lubricity and enhanced gun performance under normal and extreme heat and pressure, to reduce, minimize, and/or largely prevent the build-up of carbon and debris fouling on metal and non-metal components of the firearm, to provide enhanced easier cleaning, substantially reducing cleaning time, and/or to provide increased protection against environmental components such as dust, dirt and rust even in severe environmental applications. In at least one implementation, the gun oil composition comprises a high viscosity index (or very high viscosity index) base oil and a medium-viscosity index oil with a detergent additive. Certain implementations can also include one or more of a low viscosity penetrating oil, a low viscosity sulfurized ester, and/or additional additives.

Those of skill in the art will appreciate that a high viscosity index oil may have a viscosity index ("VI") of 80-110, a medium viscosity index oil may have a VI of 35-79, and a low viscosity index oil may have a VI of below 35, e.g., as noted below in Table I and at https://en.wikipedia.org/wiki/Viscosity_index.

TABLE 1

| Group | Viscosity Index |
|---|---|
| Low Viscosity Oil | Below 35 |
| Medium Viscosity Oil | 35-79 |
| High Viscosity Oil | 80-110 |
| Very High Viscosity Index | Over 110 |

Viscosity index (VI) is an arbitrary measure for the change of viscosity with variations in temperature. The lower the VI, the greater the change of viscosity of the oil with temperature and vice versa. Viscosity index is used to characterize viscosity changes with relation to temperature in lubricating oils. Oils with the highest VI will remain stable and not vary much in viscosity over a given temperature range (e.g., cold use versus hot use). The VI scale was set up by the Society of Automotive Engineers (SAE). The temperatures chosen arbitrarily for reference are 100° F. and 210 OF (38° C. and 99° C.). The original scale only stretched between VI=0 (lowest VI oil, naphthenic) and VI=100 (best oil, paraffinic) but since the conception of the scale better oils have also been produced, leading to VIs greater than 100.

Additional features and advantages of exemplary implementations of the present invention will be set forth in the description which follows, and in part will be apparent from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the drawings located in the specification. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION OF THE PREFERRED EMBODIMENTS

Figure 1C:
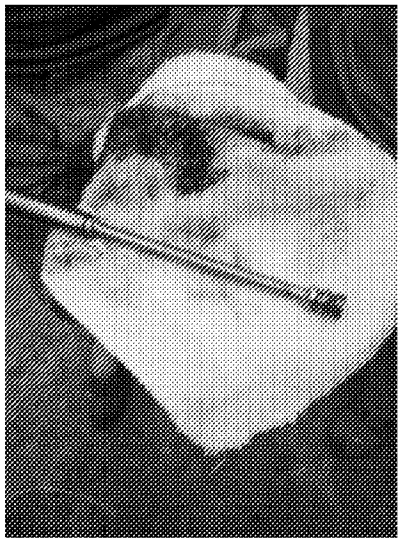
FIGS. 1A-1C are photographs showing comparative testing results when using the present gun oil compositions.

All publications, patents and patent applications cited herein, whether supra or infra, are hereby incorporated by reference in their entirety to the same extent as if each individual publication, patent or patent application was specifically and individually indicated to be incorporated by reference.

The term "comprising" which is synonymous with "including," "containing," or "characterized by," is inclusive or open-ended and does not exclude additional, unrecited elements or method steps.

The term "consisting essentially of" limits the scope of a claim to the specified materials or steps "and those that do not materially affect the basic and novel characteristic(s)" of the claimed invention.

The term "consisting of" as used herein, excludes any element, step, or ingredient not specified in the claims.

It must be noted that, as used in this specification and the appended claims, the singular forms "a," "an" and "the" include plural referents unless the content clearly dictates otherwise. Thus, for example, reference to a "detergent" includes one, two or more such detergents.

In the application, effective amounts are generally those amounts listed as the ranges or levels of ingredients in the descriptions, which follow hereto. Unless otherwise stated, amounts listed in percentage ("wt %'s") are in wt % of the particular material present in the referenced composition.

The phrase 'free of' or similar phrases as used herein means that the composition comprises 0% of the stated component, that is, the component has not been intentionally added to the composition. However, it will be appreciated that such components may incidentally form, under some circumstances, as a byproduct or a reaction product from the other components of the composition, or such component may be incidentally present within an included component, e.g., as an incidental contaminant.

Numbers, percentages, ratios, or other values stated herein may include that value, and also other values that are about or approximately the stated value, as would be appreciated by one of ordinary skill in the art. A stated value should therefore be interpreted broadly enough to encompass values that are at least close enough to the stated value to perform a desired function or achieve a desired result, and/or values that round to the stated value. The stated values include at least the variation to be expected in a typical manufacturing or formulation process, and may include values that are within 10%, within 5%, within 1%, etc. of a stated value. Furthermore, the terms "substantially", "similarly", "about" or "approximately" as used herein represent an amount or state close to the stated amount or state that still performs a desired function or achieves a desired result. For example, the term "substantially" "about" or "approximately" may refer to an amount that is within 10% of, within 5% of, or within 1% of, a stated amount or value.

Some ranges may be disclosed herein. Additional ranges may be defined between any values disclosed herein as being exemplary of a particular parameter. All such ranges are contemplated and within the scope of the present disclosure.

Implementations of the present invention provide a gun oil composition adapted to address the needs, requirements, and extreme operating environment and conditions of modern firearms. In particular, the gun oil composition is configured to provide greater lubricity and enhanced gun performance under normal and extreme heat and pressure, to reduce, minimize, and/or largely prevent the build-up of carbon and debris fouling on metal and non-metal components of the firearm, to provide enhanced easier cleaning, substantially reducing cleaning time, and/or to provide increased protection against environmental components such as dust, dirt and rust even in severe environmental applications. In at least one implementation, the gun oil composition comprises a high viscosity index (or very high viscosity index) base oil and a medium-viscosity index oil with a detergent additive. Certain implementations can also include one or more of a low viscosity penetrating oil, a low viscosity sulfurized ester, and/or additional additives.

As used herein, preventing carbon build-up relates to the reduction and prevention of fouling during operation of the firearm and from the combination of heat, pressure, and combustion by-products. Similarly, lubrication relates to reduction of friction and friction related heat. Likewise, cleaning relates to expediting removal of carbon, unburned powder, and other debris that result from operation of the firearm. Furthermore, rust and corrosion prevention relates to protecting the barrel, metal, and other corrosion prone components of the firearm from oxidation and/or other chemical alterations.

In a first implementation, the gun oil composition of the present invention comprises a medium to high (or very high) viscosity index base oil. The base oil can comprise the major component (i.e., more than 50%) of the gun oil composition. The base oil can comprise a mineral based oil, synthetic or synthetic blends such as a hydrocarbon, polyalphaolefin, polyinternal olefin, and/or API Group V esters. The base oil can comprise, for example, up to 20% by weight of esters in certain implementations. While high viscosity base oils for firearms will be known to those skilled in the art, exemplary base oils of the present invention can comprise conventional motor oil(s), synthetic motor oil(s), and/or blends thereof. According to one illustrative implementation of the present invention, the high viscosity index mineral based oil comprises a synthetic 10W-30 weight motor oil. One will appreciate, however, that other high viscosity index oils may also be suitable for use.

By way of background, Group I base oils are generally classified by those of skill in the art as including less than 90 percent saturates, greater than 0.03 percent sulfur and with a viscosity-index range of 80 to 120. Group II base oils are generally classified by those of skill in the art as including more than 90 percent saturates, less than 0.03 percent sulfur and with a viscosity index of 80 to 120. They are often manufactured by hydrocracking, a more complex process than typically used to produce Group I base oils. Group III base oils are generally classified by those of skill in the art as including greater than 90 percent saturates, less than 0.03 percent sulfur and have a viscosity index above 120. These oils are refined even more than Group II base oils and generally are severely hydrocracked (higher pressure and heat). This longer process is designed to achieve a purer base oil with higher VI and more tightly controlled characteristics. Although made from crude oil, Group III base oils are sometimes described as synthesized hydrocarbons. Group IV base oils are polyalphaolefins (PAOs). These synthetic base oils are made through a process called synthesizing. They have a much broader temperature range and are typically selected for use in extreme cold conditions and high heat applications. Group V base oils include other base oils, such as silicone, phosphate ester, polyalkylene glycol (PAG), polyolester, biolubes, and the like. These base oils are at times mixed with other base stocks to enhance the oil's properties. An example would be a PAO-based compressor oil that is mixed with a polyolester. Esters are common Group V base oils used in different lubricant formulations to improve the properties of the existing base oil. Ester oils can take more abuse at higher temperatures and will provide superior detergency compared to a PAO synthetic base oil, which in turn increases the hours of use. Group V base oils, particularly Group V esters are suitable for use within the base oil.

By way of example, the high viscosity index oil (e.g., 10W-30 full synthetic motor oil) may comprise from 10% to 90%, from 15% to 70%, from 20% to 65%, from 25% to 60%, from 30% to 50% (e.g., about 40%) of the gun oil composition.

In some implementations of the present invention, the gun oil composition comprises a medium viscosity index mineral oil. For example, a medium viscosity index mineral oil can include materials typically employed as an automatic transmission fluid (ATF). In at least one implementation, the medium viscosity index mineral oil comprises a mineral based or synthetic oil (e.g., not petroleum based) having at least one detergent additive. The medium viscosity index mineral based oil can optionally include additional additives including anti-wear additives, rust and corrosion inhibitors, dispersants and surfactants, kinematic viscosity and viscosity index improvers, anti-oxidation compounds, and/or other known ATF additives.

According to one illustrative aspect of the present invention, the medium viscosity index mineral based oil can include antiwear and/or extreme pressure agents such as sulfur, chlorine, phosphorus, boron, or combinations thereof. The classes of compounds can include alkyl and aryl disulfides and polysulfides, dithiocarbamates, chlorinated hydrocarbons, and phosphorus compounds such as alkyl phosphates, phosphites, dithiophosphites, and alkynylphosphonates. These antiwear and extreme pressure additives can function, at least in part, by thermal decomposition and/or forming products that react with a metal surface to form a solid protective layer that fills surface cavities and facilitates effective film formation to reduce friction and prevent welding and surface wear. Illustrative (metal) films can include iron halides, iron sulfides and/or iron phosphates depending upon the antiwear and extreme pressure agents used. Depending on the particular metals being protected, other metal sulfides, halides, and/or phosphates may be formed (e.g., copper or zinc sulfides, halides, and/or phosphates). Illustrative friction modifiers can form a protective film via physical and chemical absorption. In some embodiments, particulates which may be abrasive may be avoided or limited, as described herein.

By way of example, the medium viscosity index oil (e.g., an automatic transmission fluid) may comprise from 10% to 50%, from 15% to 40%, from 20% to 30%, (e.g., about 25%) of the gun oil composition.

In certain implementations, the gun oil composition further comprises a penetrating oil. The material properties and chemical compositions of certain penetrating oils will be familiar to those skilled in the art. According to one illustrative implementation of the present invention, a penetrating oil comprises one or more (severely) hydrotreated petroleum distillates, light petroleum distillates, aliphatic alcohols, glycol ethers, and/or other (proprietary) ingredients proprietary to off-the-shelf manufacturers. As described below, lower alcohols (e.g., $C_1$-$C_4$ alcohols may be avoided, such that included aliphatic and other alcohols may include longer carbon chains, or rings (e.g., $C_5$ or more, or $C_6$ or more).

Penetrating oils can, where appropriate, be characterized as having a low viscosity and can penetrate into millionth-inch spaces, effectively preventing or breaking bonds caused by, formed by, resulting in, and/or related to rust, corrosion, contamination or compression. Penetrating oils, in some instances, can allow breaking of the molecular bond of oxidation or other chemical alterations at the (first) molecular level. Disruption of these chemical bonds can occur while remaining chemically neutral (e.g., safe) relative to the underlying base metal. In some implementations, the penetrating oil can comprise or consist of a commercially available penetrating oil, such as KROIL™ or a related product or derivative thereof, such as, for example, AEROKROIL™, SILIKROIL™, PENEPHITE™, and the like (available, for example, from Kano Laboratories). Other examples of commercially available penetrating oils include DEEP CREEP™, PB BLASTER CHEMICAL™, WD-40™ Penetrant, LIQUID WRENCH™, and/or other similar products. One will appreciate, however, that one or more additional or alternative penetrating oils, including specially-designed or manufactured penetrating oils, non-commercially available penetrating oils, and/or combinations of any of the above or other penetrating oils can be appropriate in certain implementations.

By way of example, Exemplary characteristics for KROIL™ are as follows.

TABLE 2

| Property | CAS # | Characteristic |
|---|---|---|
| Severely Hydrotreated Petroleum Distillates | 64742-52-5 | 30-50% |
| Light Petroleum Distillates | 64742-95-6 | 30-50% |
| Diisobutyl ketone | 108-83-8 | 0-15% |
| Proprietary Ingredient | Proprietary | 1-10% |
| Dipropylene glycol monopropyl ether | 29911-27-1 | 1-5% |
| Dipropylene glycol methyl ether | 88917-22-0 | 0-5% |
| Aliphatic Alcohol #1 | 123-42-2 | <3% |
| Aliphatic Alcohol #2 | 78-83-1 | <3% |
| Flash Point | | 132° F. |
| Density | | 0.8596 |

Such low viscosity penetrating oils may have a viscosity of no more than about 200 cSt, no more than about 100 cSt, no more than about 50 cSt, or no more than about 25 cSt, no more than 10 cSt, no more than 5 cSt, or no more than 3 cSt. Such viscosity may be measured at any typical temperature correlating to the contemplated use (e.g., 40° C., 100° C., or the like).

In at least one implementation, the gun oil composition comprises a low viscosity sulfurized ester or other low viscosity additive such as a sulfurized fatty ester or fatty vegetable oil. The sulfurized ester additive can be adapted to provide excellent extreme pressure and antiwear properties (e.g., in combination with appropriate antiwear additives in mineral oils and/or greases), and to aid in ensuring carbon entrained within the cycled exhaust gases remains dispersed, rather than depositing onto and becoming "baked-on" to the action components. Sulfurized esters can also offer outstanding solubility characteristics in naphthenic hydrocarbons and/or solvents of base oils of the gun oil composition. Similarly, sulfurized esters can provide desired chemical properties when used in combination with ash-comprising or ashless phosphorus-type antiwear and lubricity additives.

Additionally, the sulfurized ester additive can remain inactive relative to ferrous and non-ferrous metals, particularly "yellow" metals, such as brass. The sulfurized ester additive can be selected from a family of esters useful in severe environmental applications to provide low-temperature flowability with clean, high temperature operation. According to one illustrative implementation of the present invention, the sulfurized ester can provide a combination of branching structure(s), characteristic(s), and/or properties and/or polarity that can protect metal, reduce volatility, and improve energy efficiency through higher lubricity.

Sulfurized esters are sometimes used as a "high pressure additive" for cutting lubricants in order to keep a portion of the cutting surface and workpiece coated and by reducing friction and heat so as to increase efficiency of the tools and longevity of the parts. Sulfurized ester manufacturers recommend usage of such components in relatively small amounts (e.g., up to 1%, or 1.2% in industrial gear oils for lubrication), the sulfurized ester may be included in surprisingly high concentrations within the present gun oil compositions. For example, about 20% to about 30% of the composition may comprise the sulfurized ester, which is a far higher content than typically suggested for any uses of NA-LUBE EP 5210, or other exemplary sulfurized ester products. 20% is the upper bound for recommendation in only "water miscible metal working concentrates" according to NA-LUBE's manufacturer, King Industries. The present gun oil applications are not at all water-miscible. Neither is it a concentrate. It's very unusual to include it at such a high fraction. Those of skill in the art at King Industries found it surprising that such a high fraction of the sulfurized ester was being included.

By way of example, the sulfurized ester may comprise 15%, 16%, 17%, 18%, 19%, 20%, 21%, 22%, 23%, 24%, 25%, 26%, 27%, 28%, 29%, 30%, from 15% to 30%, from 20% to 30%, or about 25% by weight of the composition.

Such a high fraction of the sulfurized ester aids in providing the desired polarity characteristics that keep the product on the metal parts, to ensure cooling, lubricating, and keeping the parts free from carbon build-up. This is particularly important under the high heat and high pressure conditions imposed in the rapid function chamber of a gas or piston operated semi-automatic (or automatic) modern firearm such as the AR or AK series. While providing such benefits, it is important to also ensure that the sulfurized ester is safe for use on "yellow" metals, such as brass, as high sulfur content, particularly high "active" sulfur content (e.g., as determined under ASTM D 1662) can result in damage to such "yellow" metals, and even other metals, over repeated use.

By way of example, the sulfurized ester may be based on fatty acid chemistry (e.g., esterification of an alcohol and an organic acid where one or both include a fatty acid chain). The fatty acid chain(s) of the sulfurized ester may be at least 6 carbons in length, at least 8 carbons in length, at least 10 carbons in length, no more than about 30 carbons in length, no more than about 26 carbons in length, from about 8 to about 24 carbons in length, from about 10 to about 20 carbons in length, or from about 12 to about 18 carbons in length. In some embodiments, the sulfurized ester may be branched, including a plurality of fatty acid chains (e.g., such as where Guerbet alcohols are used, or other branched alcohols or organic acids). Carboxylic acids and/or sulfonic acids may be employed as the organic acid in synthesis of the sulfurized ester.

Sulfur content within the sulfurized ester may be at least about 1%, at least about 3%, at least about 5%, not more than about 30%, not more than about 20%, not more than about 15%, about 1% to about 30%, about 3% to about 20%, about 5% to about 15%, about 6%, about 7%, about 8%, about 9%, about 10%, about 11%, about 12%, about 13%, about 14%, about 15%, or any range defined any such amounts. The amount of active sulfur, or that amount of sulfur that is "free" to readily react, may be limited, e.g., to less than about 5%, less than about 4%, less than about 3%, less than about 2.5%, less than about 2%, less than about 1.5%, less than about 1%, less than 0.75%, or less than 0.5%. Determination of active sulfur content may be by ASTM D 1662, or similar test method.

Limiting the content of such "active" sulfur may be important in ensuring that the resulting gun oil composition is compatible with typical "yellow" metals often used in gun components and ammunition, e.g., copper, brass, and the like. Yellow metals are those including an element which renders the alloy or other metal yellow in color. Some copper containing alloys are examples of yellow metals, such as brass and/or bronze. Brass is an alloy of copper and zinc. Brass if often used in manufacturing gun components and ammunition.

Use of a sulfurized ester that includes too high active sulfur content would result in reaction of the gun oil composition with the brass, copper, or similar metal surfaces contacted with the gun oil composition. Such reaction is undesirable, as is damages the finish of such metal surfaces, resulting in unsightly staining. As such, not all sulfurized esters are suitable for use. Examples of suitable sulfurized esters are available under the tradename NA-LUBE, particularly those with the "EP" designation (e.g., NA-LUBE EP 5210), available from King Industries, located in Norwalk, Conn. Exemplary characteristics for NA-LUBE EP 5210 are as follows.

TABLE 3

| Property | Value/Characteristic |
|---|---|
| Sulfur Content | 10.0% |
| Active Sulfur Content (ASTM D 1662) | <1.0% |
| Color (ASTM D 1500 neat) | 3.5 |
| Viscosity @ 40° C. (ASTM D 445, DIN 51 550 | 25 $mm^2/s$ (cSt) |
| Density @ 20° C. (ASTM D 941) | 0.95 g/mL |
| Weight per Gallon @ 25° C. | 7.91 lbs |
| Flash Point, COC (ASTM D 92, DIN 51 376 | 170° C. (338° F.) |

Inclusion of some sulfur is important to provide the desired extreme pressure and anti-wear properties, which are very helpful in protecting the surfaces of the gun components being lubricated. As the gun components are often those of AK or AR type weapons where exhaust gases are used to help cycle the weapon, such properties are particularly advantageous. At the same time, it is important to ensure that the active sulfur content is sufficiently low, to ensure compatibility with yellow metal gun components. Use of a sulfurized ester that includes too much active sulfur content would result in reaction of the gun oil composition with the brass, copper, or similar metal surfaces contacted with the gun oil composition. Such reaction is undesirable, as it damages the finish of such metal surfaces, resulting in unsightly staining, and may also lead to changes in the dimensions of narrow tolerance precision machined action components common in modern firearms.

The gun oil compositions may be free from components not listed as included within any examples of the present gun oil compositions disclosed herein. For example, in at least some embodiments, the composition is liquid, without any particulates included therein, particularly particulates that may be abrasive. For example, while U.S. Pat. No. 9,222,050 to Simonetti describes a gun oil composition, that formulation includes tungsten disulfide particles, diamond particles, tungsten oxide, and/or boron oxide particles. While such abrasive particles may aid in "burnishing" surfaces, they are detrimental over time when attempting to maintain the narrow tolerance dimensions of precision machined parts common in a modern firearm.

Furthermore, for the reasons mentioned above, it can be important to limit the inclusion of active sulfur not only within the sulfurized ester component of the gun oil composition, but in the composition as a whole for the same reasons. Active or "free" sulfur (such as would be provided by sulfide particles) can damage "yellow" metals such as brass, and is therefore to be avoided. As such, in at least some embodiments, active sulfur content within the gun oil composition as a whole may also be limited. Where the sulfurized ester may be the only source of active sulfur within the composition as a whole, and where such sulfurized ester may be included in an amount of about 20% to about 25% by weight (or higher) of the composition as a whole, it will be apparent that active sulfur content of the composition as a whole may thus be limited to one-fifth, or one-fourth, of any of the values noted above (e.g., limited, to less than about 1%, less than about 0.8%, less than about 0.6%, less than about 0.5%, less than about 0.4%, less than about 0.3%, less than about 0.2%, less than 0.15%, or less than 0.1%. Similar calculations could be performed based on the sulfur content values above (e.g., one-fifth, or one-fourth of 10%/, or the other above noted limits on sulfur content for the sulfurized ester component). It will thus be apparent that other components that might contribute to increased sulfur content, and/or increased active sulfur content, may be avoided, as well as abrasive particulates, or other suspended solids, such as metal oxides, metal sulfides, and the like.

While U.S. Pat. No. 9,222,050 to Simonetti is thus very different from the present gun oil compositions, its disclosure of various base oil components and some other included components may be helpful (e.g., within the confines of what the present gun oil is intended to accomplish), and is incorporated herein by reference as such.

For reasons described above, the sulfurized ester component (e.g., NA-LUBE EP 5210) may comprise at least 10%, at least 12%, or at least 15% of the gun oil composition, but may not be present in an amount of greater than 30%, or not greater than 25%. The amount of inclusion may be 15%, 16%, 17%, 18%, 19%, 20%, 21%, 22%, 23%, 24%, or 25% by weight of the gun oil formulation.

U.S. Publication No. 2006/0194701 to Gibbons describes a gun oil composition that consists essentially of 2-15% isopropyl alcohol, 20-60% heptane, and 3-20% of specific additives, which is specifically formulated to prevent rusting. It will be readily apparent that such a composition includes a very large fraction of low volatility components (particularly the isopropyl alcohol and the heptane), and that such components will easily evaporate away if used under the conditions described herein common within action components of modern firearms. It will be apparent that in at least some embodiments, the present composition may limit, or be free of lower alcohols (e.g., $C_1$-$C_4$ alcohols, such as isopropyl alcohol), or other lower carbon count alkanes (e.g., $C_1$-$C_7$), such as heptane. For example, the present composition may include no such components, no more than 1%, no more than 2%, no more than 3%, no more than 5%, or no more than 10% of any such component.

As opposed to harsh solvents often used to aid in breaking up "baked on" carbon and other debris when cleaning gun action components by scraping and brushing, the pH of the present gun oil compositions may be from 4 to 10, more typically 5 to 9, or 6 to 8 (e.g., about 7). As described herein, other characteristics of the components are selected to ensure that the gun oil composition is safe to use on "yellow" metal and other typical metal and non-metal components, and the typical metal finishes employed thereon, present within the action mechanism and elsewhere on the firearm.

Example 1

According to one illustrative implementation of the present invention, the gun oil composition can include: a major amount of a base oil mixture from about 10 wt. % to about 90 wt. % of a first mineral oil selected from a group of high viscosity index mineral oil (e.g., VI from 80 to 110) such as conventional and/or synthetic hydrocarbons, polyalphaolefins, and polyinternal olefins, and optionally including up to 20% esters; a medium viscosity oil mixture (e.g., VI from 35 to 79), such as an automatic transmission fluid from about 10 wt. % to about 50 wt. % having a mineral based oil and at least one detergent additive, and optionally including one or more additional additives, such as those known to one of ordinary skill in the art to be commonly added to automatic transmission fluid; a low viscosity penetrating oil from about 2 wt. % to about 25 wt. % comprising one or more severely hydrotreated petroleum distillates, light petroleum distillates, aliphatic alcohols, glycol ether, and/or other (proprietary) ingredients found within off-the-shelf penetrating oils; and a sulfurized ester or derivative thereof from about 2% wt. % to about 25 wt. %.

Example 2

According to another illustrative implementation of the present invention, the gun oil composition can include: a major amount of a base oil mixture from about 25 wt. % to about 60 wt. % of a first mineral oil selected from a group of high viscosity index (e.g., VI from 80 to 110) mineral oil such as conventional and/or synthetic hydrocarbons, polyalphaolefins, and polyinternal olefins, and optionally including up to 20% esters; a medium viscosity index oil mixture (e.g., VI from 35 to 79), such as an automatic transmission fluid from about 25 wt. % to about 45 wt. % having a mineral based oil and at least one detergent additive, and optionally including one or more additional additives, such as those known to one of ordinary skill in the art to be commonly added to automatic transmission fluid; a low viscosity penetrating oil from about 5 wt. % to about 15 wt. % comprising one or more severely hydrotreated petroleum distillates, light petroleum distillates, aliphatic alcohols, glycol ether, and/or other (proprietary) ingredients found within off-the-shelf penetrating oils; and a sulfurized ester or derivative thereof from about 5% wt. % to about 15 wt. %.

Example 3

According to yet another illustrative implementation of the present invention, the gun oil composition can include: a major amount of a base oil mixture from about 25 wt. % to about 50 wt. % of a first mineral oil selected from a group of high viscosity index (e.g., VI from 80 to 110) mineral oil such as conventional and/or synthetic hydrocarbons, polyalphaolefins, and polyinternal olefins, and optionally including up to 20% esters; a medium viscosity index oil mixture (e.g., VI from 35 to 79) such as an automatic transmission fluid from about 35 wt. % to about 45 wt. % having a mineral based oil and at least one detergent additive, and optionally including one or more additional additives, such as those known to one of ordinary skill in the art to be commonly added to automatic transmission fluid; a low viscosity penetrating oil from about 5 wt. % to about 15 wt. % comprising one or more severely hydrotreated petroleum distillates, light petroleum distillates, aliphatic alcohols, glycol ether, and/or other (proprietary) ingredients found within off-the-shelf penetrating oils; and a sulfurized ester or derivative thereof from about 12% wt. % to about 15 wt. %.

Example 4

According to yet another illustrative implementation of the present invention, the gun oil composition can include: a major amount of a base oil mixture from about 25 wt. % to about 50 wt. % of a first mineral oil selected from a group of high viscosity index (e.g., VI from 80 to 110) mineral oil such as conventional and/or synthetic hydrocarbons, polyalphaolefins, and polyinternal olefins, and optionally including up to 20% esters; a medium viscosity index oil mixture (e.g., VI from 35 to 79) such as an automatic transmission fluid ("ATF") from about 20 wt. % to about 30 wt. % having a mineral based oil and at least one detergent additive, and optionally including one or more additional additives, such as those known to one of ordinary skill in the art to be commonly added to automatic transmission fluid; a low viscosity penetrating oil from about 5 wt. % to about 15 wt. % comprising one or more severely hydrotreated petroleum distillates, light petroleum distillates, aliphatic alcohols, glycol ether, and/or other (proprietary) ingredients found within off-the-shelf penetrating oils; and a sulfurized ester or derivative thereof from about 18% wt. % to about 30 wt. %, or from about 18% wt. % to about 25 wt. %.

Other additives may be added, e.g., to any of the above examples. For example, a colorant may be included. A scent or odorant (e.g., leather scent) or other desired scent or fragrance (employed interchangeably herein) may be included. For example, such additives may be included in an amount of up to 0.1%, up to 0.3%, up to 0.5%, or up to 1% by weight of the gun oil composition. Polytetrafluoroethylene (PTFE) "TEFLON" or similar fluorinated polymer particles may be included. Such particles are typically not hard enough to be abrasive, but may aid in lubrication. GS 150 PTFE, available from Shamrock, is an example of such. Such fluorinated polymer particles may be included in an amount of not more than about 10%, not more than about 5%, not more than about 3%, at least 0.1%, at least 0.5%, at least 1%, from 1% to 5%, from 1% to 3%, or about 2% by weight of the gun oil composition. Such particles typically remain suspended or dissolved within the composition, so no shaking is required prior to application.

While the gun oil compositions are described as typically including a high viscosity index base oil component and a medium viscosity index component, it will be appreciated that in some embodiments, the recited viscosity index values may be minimums, e.g., so that the ATF employed as the medium viscosity index component may actually have a viscosity index greater than that within the medium range (i.e., it may be greater than 79, such as it may fall within the "high" range, or within the "very high" range. Similarly, the base oil having a "high" viscosity index is at least that of a high viscosity index, so that a "very high" viscosity index base oil can be used.

The gun oil composition of the present invention can provide an immediate and/or substantially improved lubricity, improved performance under extreme heat and/or pressure, can minimize and/or largely prevents the build-up of carbon and/or debris (fouling) on metal and non-metal components of the firearm, and can substantially reduce cleaning time while providing increased protection against environmental components such as dust, dirt and rust, all while being safe to use on "yellow" metals such as brass. It will be appreciated by those skilled in the art that the gun oil composition of the present invention provides improved performance not only under normal operating conditions, but also in extreme operating environments of high heat, high pressure, and/or during prolonged activity and/or repeated use.

The gun oil composition can include components that are highly viscous, components that are moderately viscous with desirable anti-wear and high pressure performance capabilities, and components that have low viscosity and penetrating properties with additives that can reduce volatility and improve energy efficiency through higher lubricity. Thus, implementations of the gun oil composition can be well-suited to the needs of modern firearms by providing both rust and corrosion resistance, and can provide and/or allow: substantially enhanced lubricity performance under extreme heat and pressure; and substantial improvement in preventing buildup of carbon, debris, and other environmental contaminants by trapping, controlling, and/or removing the same said contaminants.

Field Tests

A gun oil composition according to the present invention such as those described herein was field tested in rifles, shotguns, and pistols under a variety of temperatures, environments, and functional stresses. Specifically, and most revealingly, testing encompassed modern gas-operated firearms that employ the hot, carbon-laden gases of a cartridge discharge to cycle the firearm system (e.g., AR and AK weapons, such as the AR-15 and the AK-47). This carbon and unburned powder, along with microscopic fragments, shavings, and particles of brass, lead, or other metals scraped from the cartridge casing and projectile create an unavoidable by-product entrained within the exhaust gases that functionally impairs the firearm's action over time.

The present formulations resulted in a uniquely performing product that not only kept the weapon systems lubricated under heavy use, but also prevented the permanent buildup and re-adherence of carbon and other fouling in the actions of the test firearms. As those of skill in the art will appreciate, the action of the firearm is the mechanism or combination of components that handle loading, locking, firing, and extraction of the cartridge and projectile. Because such action components are repeatedly subjected to the exhaust gases laden with carbon and metal fragments, shavings, and particles as described above, such action components tend to require frequent cleaning, and can often undergo undesirable wear or other damage resulting from such exposure. Post-use cleaning of such action components typically requires heavy scrubbing, scraping with metallic tools, and/or the use of harsh pH or otherwise harsh chemicals to remove "baked on" carbon and other deposits which build up on such action components over time. Such vigorous, harsh cleaning can frequently damage the action components, particularly the paint or other metal finishes applied thereto.

Figure 1B:
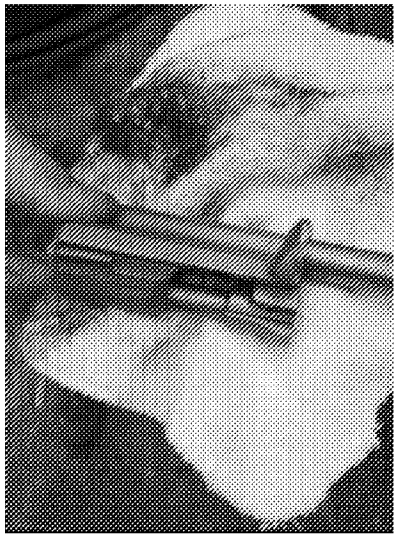
Figure 1A:
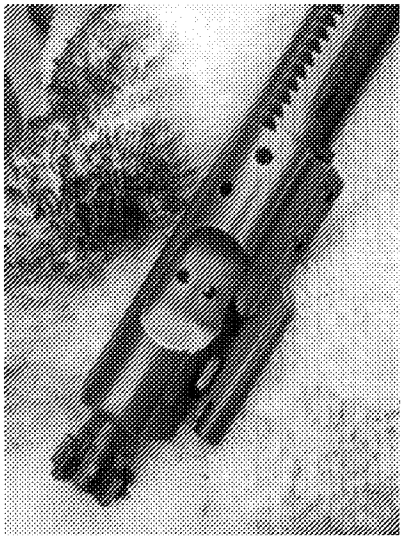
Figure 2A:
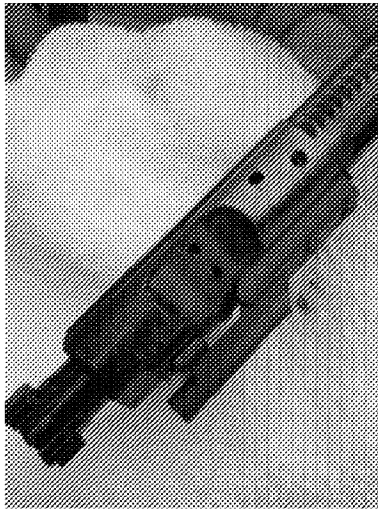
FIGS. 2A-2C are photographs showing comparative testing results when using a conventional gun oil composition.
Figure 2B:
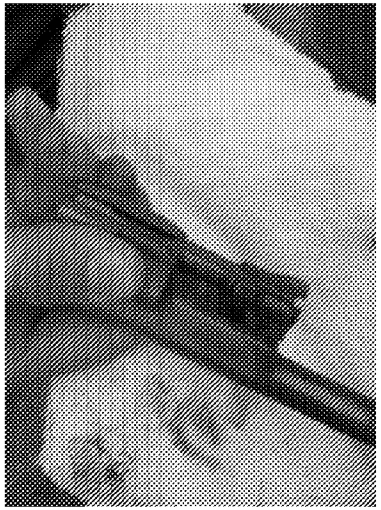
Figure 2C:
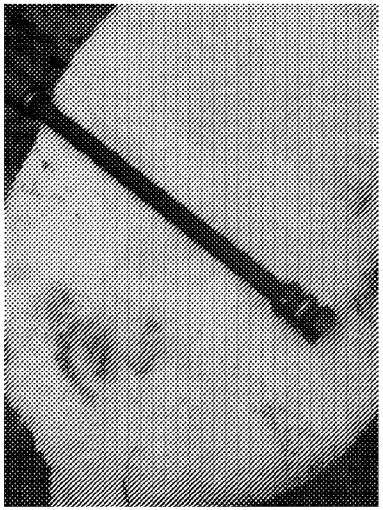

In field testing the present formulations, in contrast, post-use cleaning did not require the typical heavy scrubbing, scraping with metallic tools, or the use of harsh chemicals. Rather, carbon fouling, lead deposits, and brass filings simply wiped off with the simple use of a cotton towel. FIGS. 2A-2C show how when using a traditional gun oil for lubrication, very little of the carbon entrained and suspended within the exhaust gases is able to be removed when wiping the action components with a white cotton towel. This is because the majority (even vast majority) of the carbon has become "baked on" to the action components, making its removal difficult. In contrast, FIGS. 1A-1C show the same action components having been used under the same conditions, but with the present gun oil formulation applied thereto prior to use. As seen in FIGS. 1A-1C, the carbon fouling is very apparent, but the carbon fouling is easily wiped off the action components and onto the white cotton towel. The present gun oil formulations are able to maintain the carbon in the exhaust gases in a suspended, free, or un-bonded state within the lubricating gun oil composition, so that the carbon does not become "baked-on" to the action components, but is instead easily wiped away. In order to remove the "baked-on" carbon fouling present in FIGS. 2A-2C, extended scraping and the use of harsh chemicals is required. The present formulations are able to prevent the need for such remediation (and the typical resulting wear and damage) by simple lubrication of the components with the present formulation prior to use. The results achieved by the present gun oil lubricating compositions are far superior, surprising, and unexpected. Other than the present gun oil formulations, no gun oil lubricants are available that provide such superior results.

By way of example, the present gun oil compositions may allow at least 25%, at least 30%, at least 40%, at least 50%, at least 60%, at least 70%, at least 80%, at least 90%, or at least 95% of carbon entrained within the exhaust gases to remain entrained, suspended, and unbonded, within the gun oil composition, preventing a significant fraction, and even substantially all such carbon from becoming "baked-on" during use of the gun oil composition. Such is an enormous advantage over the current state of the art.

The present gun oil formulations have been found to continue to "wet" the action components, even after extended use, rather than baking, evaporating, or otherwise leaving a dry surface on the action components. The result is that the action components remain "wet" during use, and the carbon fouling and metal filings resulting from use are simply wiped away, easily, with no scraping or other chemicals required to remove fouling and other build-up. This is so even after firing hundreds or even thousands of rounds through the action mechanism between wipe down and re-application of the gun oil formulation. For example, a typical user may fire at least 100 rounds, at least 200 rounds, at least 300 rounds, at least 500 rounds, at least 1000 rounds, at least 2000 rounds, or more, without having to break down the action mechanism, wipe down the components, and re-apply the gun oil composition, while still achieving the results described herein of preventing build-up of baked-on carbon, maintaining "wet" lubrication of the action components and the like.

Figure 3A:
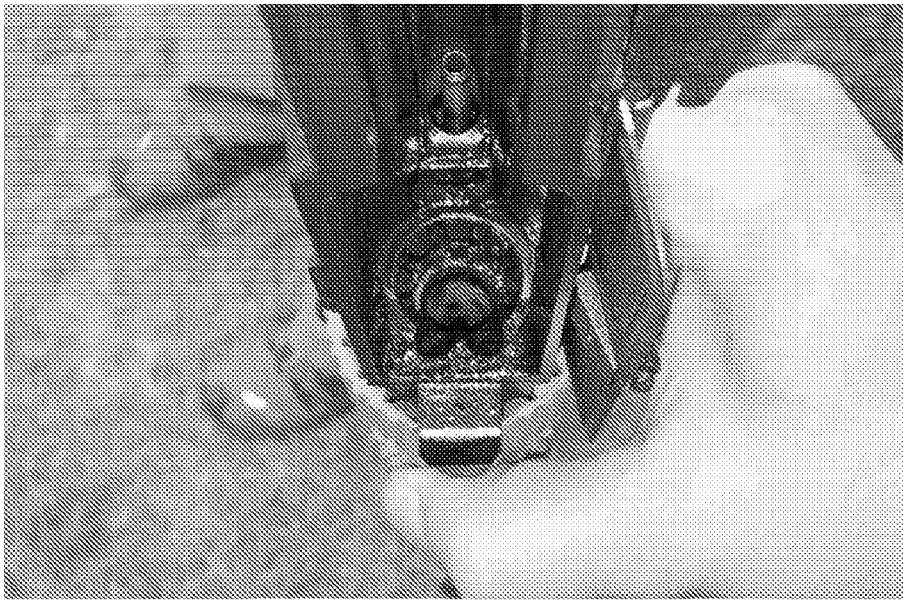
FIGS. 3A-3B are photographs showing further field test evidence with an AR direct impingement (e.g., AR-15) action mechanism.
Figure 3B:
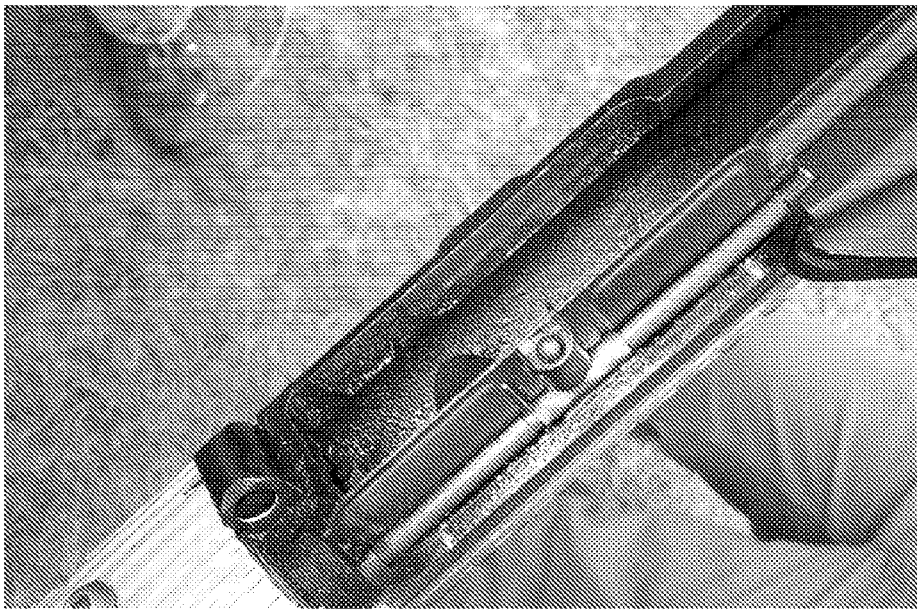
Figure 4A:
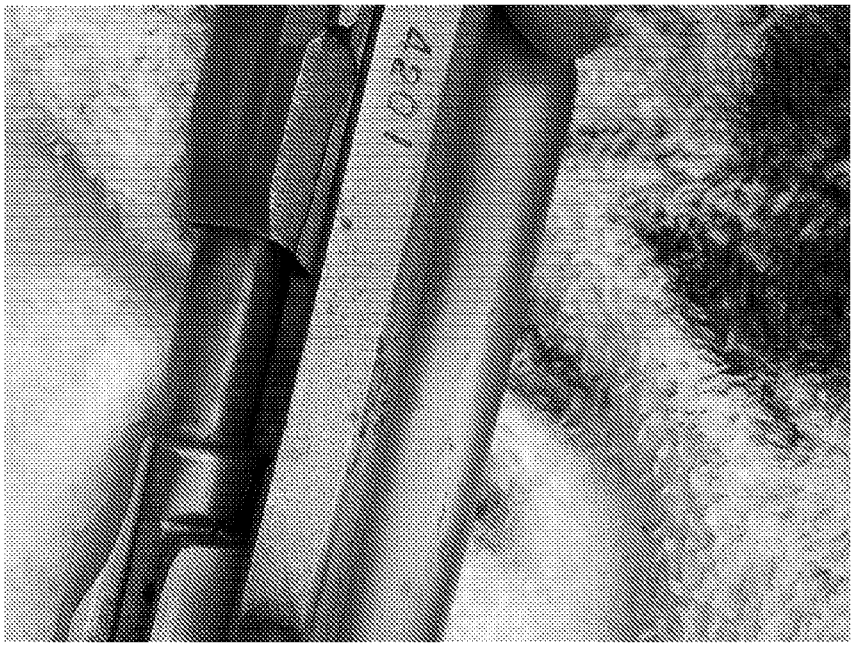
FIGS. 4A-4B are photographs showing further field test evidence with an AK piston driven (e.g., AK-47) action mechanism.
Figure 4B:
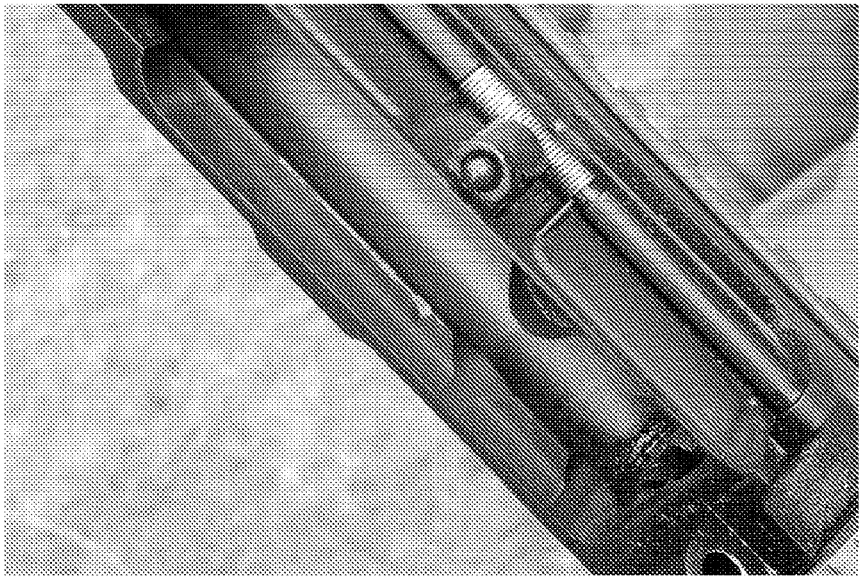

FIGS. 3A-3B are additional photographs showing further field test evidence with an AR direct impingement (e.g., AR-15) action mechanism. FIGS. 4A-4B similarly show field test evidence with an AK piston driven (e.g., AK-47) action mechanism. In both sets of photographs, though the action components are blackened with the unavoidable carbon and metallic by-product from the cycling of the weapon, the internal action components are still effectively lubricated despite the heat and pressure of heavy use within a short period of time. The vast majority of carbon, brass filings, and unburned powder are entrained within the gun oil composition, so as to be easily wiped clean with minimal pressure (e.g., hand wiping with a towel or other rag), no metal tools, and no harsh chemicals (or any chemicals at all, really). Approximately 2500 rounds were fired through both actions seen in FIGS. 3A-4B, as well as the actions seen in FIGS. 1A-2C.

The advantage of such performance will be readily apparent where many of the action components are precision machined to very tight tolerances, and where deviation from those tolerances (either by carbon fouling or other build-up, or by extended scraping when attempting to remove such build-up) can result in the action mechanism becoming jammed, damaged so as to affect performance, or otherwise unworkable.

One user stated "[the present gun oil formulation] succeeds where competitors fail. The lube stays with the parts, keeps them running cool and more efficiently and for longer intervals. Cleaning time is reduced dramatically requiring a simple wipe down and re-application of the product to get the weapon back in the fight" (Sergeant M. W., United States Marine Corps).

In development and testing, one important purpose of the present formulations was to address a common problem suffered by modern firearms—the diminished functionality created by the buildup of friction, heat, and carbon fouling created by the hot gases employed to cycle the weapon. Existing gun oil lubricants focus primarily on rest prevention, secondarily or really only incidentally on lubrication, and perhaps aspire to aid in the cleaning process. The reality is that cleaning after use of such products requires excessive time and effort using metallic brushes, scraping tools, and harsh solvents. The present gun oil formulations approached this pervasive problem in a novel way by formulating a lubricant that 1) would adhere to the metal parts under extreme pressure and heat without a specialized application process, tools, or conditions (i.e., simply wipe it on); 2) remain "wet" under heavy use and heat; 3) prevent the re-adherence of contaminant fouling to the metal parts; 4) penetrate micro-crevices with a penetrating component to clean areas inaccessible by brushes or picks; and 5) facilitate fast and simple cleaning with a simple cloth wipe down. Other than the present formulations, no existing product meets these criteria.

The present inventor has overseen testing of the present formulations via active duty military, law enforcement, and recreational tactical shooters in a variety of heavy use, high round-count conditions to include extreme cold (−15° F.), extreme heat (>105° F.), from sea level to 8,000 feet above sea level, in rain, snow, mud, sand, and arid conditions. A variety of weapon systems were tested, including direct impingement semi-automatic rifles (AR-style), piston-driven (AK-style rifles), belt-fed/crew served (fully automatic) machine guns, semi-automatic magazine-fed handguns in suppressed (with a silencer) and unsuppressed configurations in calibers from .22 caliber rimfire to .50 Browning Machine Gun ("BMG") high velocity centerfire cartridges.

Throughout the process, ongoing tests and formulaic adjustments proved that a modern firearm lubricant will include the following elements to be truly exceptional: a synthetic lubricant base oil of sufficient viscosity to apply easily, yet maintain lubricity under extremes of heat, cold, pressure, and friction; a detergent capable of dissolving carbon fouling and other contaminants created during the discharge of high pressure ammunition; a dispersant capable of preventing the contaminants from re-adhering to the bearing surfaces as the weapon's parts increased in temperature during extreme use; a penetrant capable of reaching the micro-crevices not accessible to scraper tools and brushes; and in which all components are chemically mild enough not to damage "yellow" metal (e.g., brass) components, non-metal components or synthetic finishes.

In all tests the lubricant produced consistent results unmatched by current market offerings. In all cases and applications, the weapon's parts remained lubricated and functional despite extreme use. This included tests with both match grade, non-corrosive ammunition as well as corrosive, military surplus ammunition of Eastern European (former Communist Bloc) manufacturers.

Figure 5:
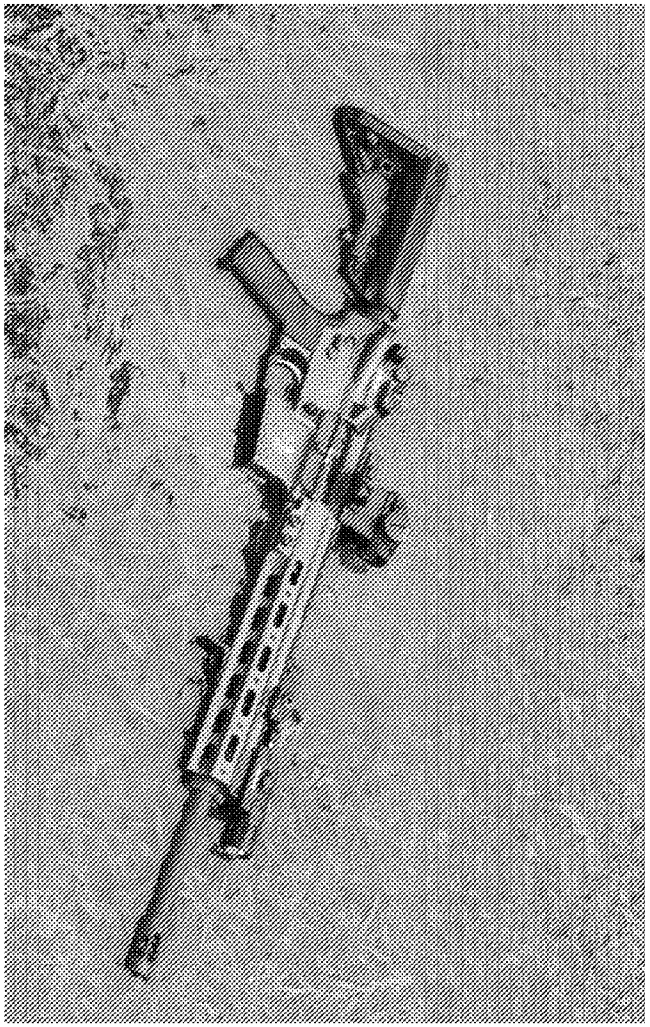
FIG. 5 shows a photograph of where testers threw a lubricated rifle into a marsh to introduce a variety of foreign contaminants into the action and barrel.

Field tests included submersion in water, mud, sand, algae, and a variety of conditions to attempt to disrupt the lubricant's ability to protect the weapon's moving parts. FIG. 5 shows a photograph of where testers threw a lubricated rifle into a marsh to introduce a variety of foreign contaminants into the action and barrel. In this case, the rifle was removed from the water, cycled manually, loaded, and fired repeatedly without failure.

The gun oil formulation employed in the above described field tests had the following composition as described in Tables 4A-4B.

TABLE 4A

| Component | Identity | Weight Percent |
|---|---|---|
| Base Oil of High VI | NAPA 10W-30 Full Synthetic Motor Oil | 40% |
| Medium VI Oil with Detergent | AMSOIL Synthetic ATF | 25% |
| Low Viscosity Penetrating Oil | KANO Laboratories KROIL | 10% |
| Sulfurized Ester | KING INDUSTRIES NA-LUBE EP 5210) | 25% |

To the base composition of Table 3A were added the following additives shown in Table 3B.

TABLE 4B

| Component | Identity | Amount Added |
|---|---|---|
| PTFE Particles | SHAMROCK GS150 PTFE | 2% |
| Colorant (Red/Blue) | ROBERT KOCH INDUSTRIES | 0.005 fl. oz per 4 oz |
| Leather Odorant/Scent | ROBERT KOCH INDUSTRIES | 0.008 fl. oz per 4 oz |

It will be appreciated by those skilled in the art that the performance enhancement provided by implementations of the gun oil composition of the present invention is not only a result of the chemical formulation of the combined components and additives, individually or collectively, at lower temperatures and under milder (loading) conditions, but also as a result of the chemical properties thereof pursuant to thermal decomposition and any resultant products that may result during extreme temperature, pressure, and/or other factors in extreme operating environments. Thus, implementations of the present invention can provide additional benefits, qualities, and/or properties as the components themselves are exposed to normal and/or extreme operating conditions (or undergo chemical, physical, or other changes thereby).

The present invention may be implemented and/or embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. A lubricant composition, comprising:

a first base oil; and a third base oil;

a sulfurized ester comprising from about 15% wt. % to about 30 wt. % of the lubricant composition; and an oil mixture comprising a second base oil and at least one detergent;

wherein the composition is free of tungsten disulfide particles;

wherein the sulfurized ester includes an active sulfur content of less than 1% to ensure compatibility of the lubricant composition with yellow metals.

2. The lubricant composition of claim 1, wherein the first base oil comprises a synthetic oil.

3. The lubricant composition of claim 2, wherein the synthetic oil comprises a polyalphaolefin or an API Group V ester.

4. The lubricant composition of claim 3, wherein the first base oil comprises a 10W-30 weight oil.

5. The lubricant composition of claim 1, wherein the first base oil comprises one or more esters, the one or more esters present at a concentration up to 20% by weight.

6. The lubricant composition of claim 1, wherein the first base oil comprises from about 10 wt. % to about 90 wt. % of the lubricant composition, the oil mixture comprises from about 10 wt. % to about 50 wt. % of the lubricant composition, and the third base oil comprises from about 2 wt. % to about 25 wt. % of the lubricant composition, and the sulfurized ester comprises from about 2% wt. % to about 30 wt. % of the lubricant composition.

7. The lubricant composition of claim 6, wherein the first base oil comprises from about 25 wt. % to about 60 wt. % of the lubricant composition, the oil mixture comprises from about 25 wt. % to about 45 wt. % of the lubricant composition, and the third base oil comprises from about 5 wt. % to about 15 wt. % of the lubricant composition, and the sulfurized ester comprises from about 10% wt. % to about 30 wt. % of the lubricant composition.

8. The lubricant composition of claim 7, wherein the first base oil comprises from about 25 wt. % to about 50 wt. % of the lubricant composition, the oil mixture comprises from about 35 wt. % to about 45 wt. % of the lubricant composition, the third base oil comprises from about 5 wt. % to about 15 wt. % of the lubricant composition, and the sulfurized ester comprises from about 18% wt. % to about 25 wt. % of the lubricant composition.

9. The lubricant composition of claim 1, further comprising at least one additive selected from an anti-wear additive, a rust inhibitor, a corrosion inhibitor, a dispersant, a surfactant, a kinematic viscosity improver, a viscosity index improver, an anti-oxidant, or an anti-oxidation compound.

10. The lubricant composition of claim 1, wherein the oil mixture further comprises an anti-wear and extreme pressure agent comprising one or more of chlorine, phosphorus, boron, or combinations thereof.

11. The lubricant composition of claim 10, wherein the anti-wear and extreme pressure agent comprises one or more of alkyl disulfides, aryl disulfides, alkyl polysulfides, aryl polysulfides, dithiocarbamates, chlorinated hydrocarbons, phosphorus compounds, alkyl phosphites, phosphates, dithiophosphates, or alkynylphosphonates.

12. The lubricant composition of claim 1, wherein the third base oil comprises one or more of petroleum distillates, light petroleum distillates, aliphatic alcohols, or glycol ethers.

13. The lubricant composition of claim 1, wherein the third base oil is configured to remain chemically neutral to a metal substrate while penetrating into millionth-inch spaces thereon.

14. The lubricant composition of claim 1, wherein the sulfurized ester is an esterification product of an alcohol and an organic acid where one or both of the alcohol or the organic acid include a fatty acid chain that is from 12 to 18 carbons in length.

15. The lubricant composition of claim 1, wherein the sulfurized ester has the following properties:

| Property | Value/Characteristic |
|---|---|
| Sulfur Content | 10.0% |
| Active Sulfur Content (ASTM D 1662) | <1.0% |
| Color (ASTM D 1500 neat) | 3.5 |
| Viscosity @ 40° C. (ASTM D 445, DIN 51 550 | 25 $mm^2/s$ (cSt) |
| Density @ 20° C. (ASTM D 941) | 0.95 g/mL |
| Weight per Gallon @ 25° C. | 7.91 lbs |
| FlashPoint, COC (ASTMD 92, DIN 51 376 | 170° C. (338° F.). |

16. A lubricant composition, comprising:

a first base oil; and a third base oil;

a sulfurized ester comprising from about 15% wt. % to about 30 wt. % of the lubricant composition; and an oil mixture comprising a second base oil and at least one detergent;

wherein the composition is free of tungsten disulfide particles;

wherein the lubricant composition has a pH from 6 to 8.

17. The lubricant composition of claim 16, wherein the sulfurized ester has the following properties:

| Property | Value/Characteristic |
|---|---|
| Sulfur Content | 10.0% |
| Active Sulfur Content (ASTM D 1662) | <1.0% |
| Color (ASTM D 1500 neat) | 3.5 |
| Viscosity @ 40° C. (ASTM D 445, DIN 51 550 | 25 $mm^2/s$ (cSt) |
| Density @ 20° C. (ASTM D 941) | 0.95 g/mL |
| Weight per Gallon @ 25° C. | 7.91 lbs |
| Flash Point, COC (ASTM D 92, DIN 51 376 | 170° C. (338° F.). |

18. The lubricant composition of claim 16, wherein the sulfurized ester includes an active sulfur content of less than 1% to ensure compatibility of the gun oil composition with yellow metals.

19. A method of lubricating an object, comprising:

applying a lubricant composition to a metal surface of the object, the lubricant composition comprising:

a first base oil;

a third base oil;

a sulfurized ester comprising from about 15% wt. % to about 30 wt. % of the lubricant composition; and an oil mixture comprising a second base oil and at least one detergent;

wherein the lubricant composition is free of tungsten disulfide particles;

wherein the lubricant composition:

(i) has a pH from 6 to 8; or (ii) wherein the sulfurized ester includes an active sulfur content of less than 1% to ensure compatibility of the lubricant composition with yellow metals.

20. The method of claim 19, wherein the first base oil comprises from about 10 wt. % to about 90 wt. % of the lubricant composition, the oil mixture comprises from about 10 wt. % to about 50 wt. % of the lubricant composition, and the third base oil comprises from about 2 wt. % to about 25 wt. % of the lubricant composition, and the sulfurized ester comprises from about 15% wt. % to about 30 wt. % of the lubricant composition.

21. The method of claim 20, wherein the first base oil comprises from about 25 wt. % to about 60 wt. % of the lubricant composition, the oil mixture comprises from about 25 wt. % to about 45 wt. % of the lubricant composition, the third base oil comprises from about 5 wt. % to about 15 wt. % of the lubricant composition, and the sulfurized ester comprises from about 18% wt. % to about 25 wt. % of the lubricant composition.

22. The method of claim 21, wherein the first base oil comprises from about 25 wt. % to about 50 wt. % of the lubricant composition, the oil mixture comprises from about 20 wt. % to about 30 wt. % of the lubricant composition, the third base oil comprises from about 5 wt. % to about 15 wt. % of the lubricant composition, and the sulfurized ester comprises from about 18% wt. % to about 25 wt. % of the lubricant composition.

23. The method of claim 19, wherein the object is a firearm, wherein the lubricant composition ensures that at least about 50% of carbon entrained within exhaust gases remains entrained within the lubricant composition, so as to prevent or minimize such carbon from becoming "baked-on" during use of the firearm.

24. The method of claim 19, wherein the sulfurized ester includes an active sulfur content of less than 1% to ensure compatibility of the lubricant composition with yellow metals.

25. The method of claim 19, wherein the sulfurized ester is an esterification product of an alcohol and an organic acid where one or both of the alcohol or the organic acid include a fatty acid chain that is from 12 to 18 carbons in length.

26. The method of claim 19, wherein the sulfurized ester has the following properties:

| Property | Value/Characteristic |
|---|---|
| Sulfur Content | 10.0% |
| Active Sulfur Content (ASTM D 1662) | <1.0% |
| Color (ASTM D 1500 neat) | 3.5 |
| Viscosity @ 40° C. (ASTM D 445, DIN 51 550 | 25 $mm^2/s$ (cSt) |
| Density @ 20° C. (ASTM D 941) | 0.95 g/mL |
| Weight per Gallon @ 25° C. | 7.91 lbs |
| Flash Point, COC (ASTM D 92, DIN 51 376 | 170° C. (338° F.). |

27. The method of claim 19, wherein the lubricant composition has a pH from 6 to 8.

* * * * *